United States Patent [19]

Sweet

[11] Patent Number: 4,770,251

[45] Date of Patent: Sep. 13, 1988

[54] ESCUTCHEON ASSEMBLY

[76] Inventor: Don A. Sweet, 12701 Barratt La., Santa Ana, Calif. 92705

[21] Appl. No.: 934,435

[22] Filed: Nov. 24, 1986

[51] Int. Cl.[4] ..... A62C 37/12

[52] U.S. Cl. ..... 169/37; 137/359; 285/46; D23/259

[58] Field of Search ..... 169/37–42, 169/90, 91; 285/46; 137/357, 359; 239/209, 288, 288.3, 288.5; D8/352; D23/36, 31, 6; D29/1, 2, 5; 126/317

[56] References Cited

U.S. PATENT DOCUMENTS

| | | | |
|---|---|---|---|
| 353,505 | 11/1886 | Rollins | 126/317 |
| 1,201,349 | 10/1916 | Rosenfeld | 126/317 |
| 1,539,371 | 5/1925 | Scott et al. | 126/317 |
| 2,594,843 | 4/1952 | Barfus | 285/46 X |
| 2,863,258 | 12/1958 | Gish | 294/50.7 X |
| 3,007,528 | 11/1961 | Gloeckler . | |
| 3,815,821 | 6/1974 | Metcalfe . | |
| 3,823,964 | 7/1974 | Politz | 285/46 |
| 3,964,549 | 6/1976 | McGill . | |
| 4,019,582 | 4/1977 | Gangell . | |
| 4,117,887 | 10/1978 | Anderson . | |
| 4,215,751 | 8/1980 | Mears . | |
| 4,282,684 | 8/1981 | McLellan | 294/50.7 X |
| 4,366,866 | 1/1983 | Sweeney . | |
| 4,407,023 | 10/1983 | Norton . | |
| 4,490,954 | 1/1985 | Cresti . | |

FOREIGN PATENT DOCUMENTS

| | | | |
|---|---|---|---|
| 1422846 | 1/1976 | United Kingdom | 285/46 |

*Primary Examiner*—Galen Barefoot
*Assistant Examiner*—Paul E. Salmon
*Attorney, Agent, or Firm*—John E. Vanderburgh

[57] ABSTRACT

In accordance with the present invention there is provided an escutcheon assembly which includes a skirt member adjustably carried by a drop line cover for adjustment of the skirt member against the ceiling panel. The drop line cover comprises an open-ended cylinder which defines a pair of articulated members which are movable with respect to each other between an open and a closed position for placement or removal of the drop line cover from a drop line without interrupting the integrity of the system.

1 Claim, 2 Drawing Sheets

ESCUTCHEON ASSEMBLY

FIELD OF THE INVENTION

The invention relates to an escutcheon assembly for masking a surface around a line which emerges therefrom and more particularly to an escutcheon assembly which can be removed from the line without interrupting the integrity of the system.

BACKGROUND OF THE INVENTION

Escutcheon assemblies are used, primarily for decorative purposes, to mask the holes in wall and ceiling surfaces through which a line extends. Escutcheon assemblies are utilized as part of ceiling fixtures, particularly for fire sprinkler systems in which it is necessary for a drop line and sprinkler head to extend through a ceiling. Of particular concern, however, is the repair or replacement of a ceiling or a portion of a ceiling in the event of a leak in the sprinkler system after it has been installed. Conventionally the fire sprinkler system is installed and tested prior to the installation of the ceiling. Escutcheon assemblies of the design to which the present invention relates, when utilized with sprinkler fire extinguisher systems are normally preinstalled on the drop line prior to installation of the sprinkler head and prior to installation of the ceiling panels. Following testing and approval of the fire sprinkler system, the ceiling panels are then installed and the escutcheon assemblies positioned against the ceiling panels to hide the holes through which the sprinkler lines extend.

Although a number of escutcheon designs are available in the prior art, the present invention is directed to an adjustable assembly which includes a drop line cover which covers the extending portion of the drop line through the ceiling and an adjustable skirt member which is frictionally carried by the drop line cover and which can be readily adjusted to fit snugly against the ceiling panels. This type of escutcheon assembly design, however, is subject to some problems in that the drop line cover must be positioned on the drop line prior to installation of the sprinkler head. This means that once installed, the drop line cover cannot be removed or replaced without destroying the dropline cover or without interrupting the integrity of the sprinkler system which is highly undesirable once the system has been installed, tested and approved. By the same token it is often necessary to break through the ceiling at points adjacent the sprinkler heads to repair or replace the ceiling panels or to permit access to areas behind the ceiling panel. Under those circumstances it is usually necessary to remove the escutcheon assemblies from the sprinkler head lines in order to permit removal of the ceiling surface or the ceiling panel in that area. With conventionally designed escutcheon assemblies it is necessary to destroy the assembly to remove it or remove the sprinkler head and thus interrupt the integrity of the sprinkler system which is to be avoided if at all possible.

Accordingly it would be helpful to have an escutcheon assembly which is reusable and which can be assembled and disassembled on the sprinkler line without interrupting the integrity of the sprinkler system.

SUMMARY OF THE INVENTION

In accordance with the present invention there is provided an escutcheon assembly which includes a skirt member adjustably carried by a drop line cover for adjustment of the skirt member against the ceiling panel. The drop line cover comprises an open-ended cylinder which defines a pair of articulated members which are movable with respect to each other between an open and a closed position for placement or removal of the drop line cover from a drop line without interrupting the integrity of the system.

In one embodiment of the invention the line cover is cut on opposite walls in a plane parallel to the axis of rotation of the line cover. The plane extends through one end of the line cover and terminates at a point in the line cover spaced inwardly from the opposite end so that an uncut portion remains between the terminus of the cut and the end of the line cover. This uncut portion defines a hinge which permits the articulated members of the line cover to pivot about an axis normal to the axis of rotation of the line cover so that the members are movable between a closed position and an open position with the ends opposite the hinge area being spaced apart for removal of the line cover without interrupting the integrity of the system.

In another embodiment one wall of the line cover is slit along its entire length in a direction parallel to the axis of rotation of the line cover and hinge means are provided on the opposite wall surface so that the opposing members are movable about an axis parallel to the axis of rotation of the line cover.

The drop line cover may also be composed of two separate members which are hingedly joined together or, as described above, may comprise a single member which is cut in the fashion described so that a portion of the material of the line cover forms the hinge.

The invention is more fully described hereinafter in conjunction with the following drawings.

DETAILED DESCRIPTION OF THE INVENTION

Figure 1:
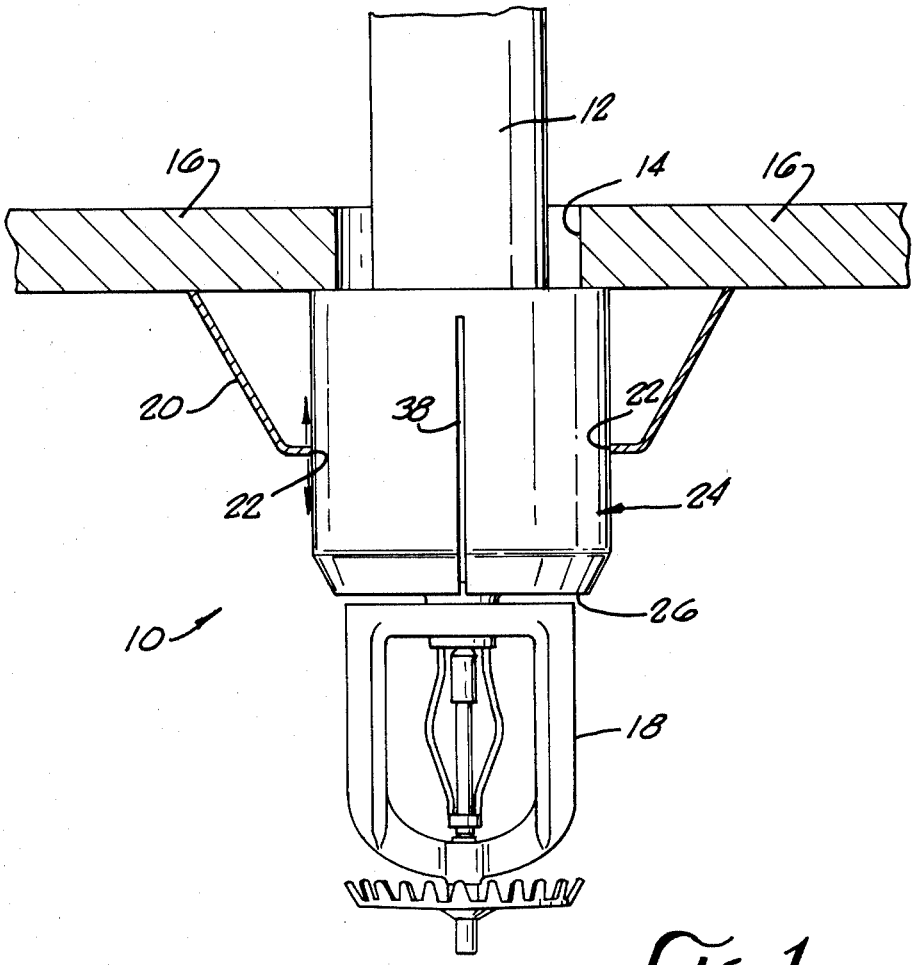
FIG. 1 is a side view, partly in section and partly cut away for compactness of illustration, of one embodiment of the escutcheon assembly of the present invention.

Referring to FIG. 1, the escutcheon assembly 10 is shown in position on a drop line 12 which extends through a hole 14 in a ceiling surface such as a ceiling panel 16. A sprinkler head 18 is disposed on the extending end of the drop line 12 for distribution of fire prevention fluid in the event of a fire. The drop line 12 is connected to a source of fire prevention fluid, not shown.

The escutcheon assembly 10 comprises a skirt member 20 which is preferably of frustoconical shape and which is provided at its narrow end with an opening 22 in which is received an open-ended, generally cylindrical drop line cover 24. The lower end 26 of the drop line cover 24 is preferably inwardly turned so as to define at the lower end 26 an opening 28 of substantially the same diameter as the drop line 12 and which further provides a shoulder which cooperates with a corresponding shoulder on the sprinkler head assembly 10 to support the drop line cover 24. The upper end of the drop line cover 24 may similarly be inwardly turned, although this is not necessary. The opening 22 of the skirt member 20 is substantially the same diameter or slightly less than the outside diameter of the drop line cover 24 so that there is a friction fit of the skirt member 20 on the drop line cover 24 which permits the skirt member 20 to be adjusted along the drop line cover 24 so that the upper edge of the skirt member 20 contacts the ceiling panel 16.

Figure 2:
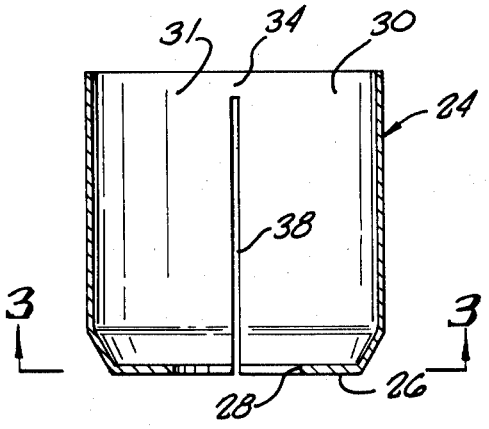
FIG. 2 is a side elevation in section of the drop line cover of the escutcheon assembly illustrated in FIG. 1.
Figure 3:
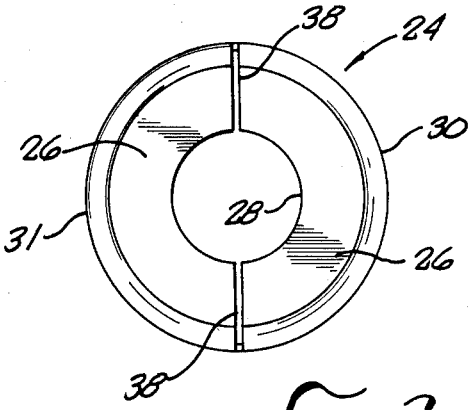
FIG. 3 is a bottom view of the drop line cover of FIG. 1.
Figure 4:
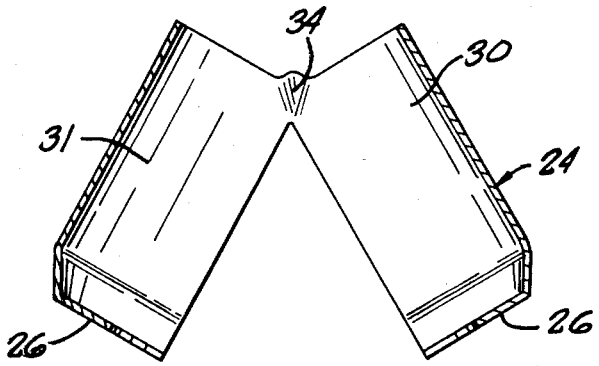
FIG. 4 is a side elevation in section showing the drop line cover of FIG. 2 in the open position.

As shown in FIGS. 1–4, the drop line cover 24 of the escutcheon assembly 10 of the present invention comprises a pair of articulated members 30 and 31 which, by means of a hinge areas 34 located on opposite sides of the drop line cover 24 adjacent its upper end, are movable with respect to one another between a closed position, as is shown in FIGS. 1 and 2 and an open position as shown in FIG. 4. In the closed position the edges of each of the members 30 and 31 are contiguous so that the drop line cover 24 is in its normal open-ended cylindrical configuration. However, in this position, the drop line cover 24 can not be removed without manipulating the drop line cover or removing the sprinkler head 18 and thus breaking the integrity of the sprinkler system. As is most clearly shown in FIG. 4, the members 30 and 31 pivot away from each other about points defined at the hinge areas 34 so that the lower ends of each of the members 30 and 31 opposite the hinge areas 34 are widely spaced from one another and the edges of the members 30 and 31 are no longer contiguous. In this position the drop line cover 24 can be removed without removing the sprinkler head 18, thus permitting access to the ceiling surface for repair or replacement purposes without breaking the integrity of the sprinkling system and without destroying the drop line cover.

In the preferred form of the invention, as illustrated in FIGS. 2, 3 and 4, the opposable members 30 and 31 are defined in the drop line cover 24 by slitting the cover 24 in a plane parallel to its axis of rotation thereby to define a slit 38 on opposite sides of the drop line cover 24 which extends from the lower end 26 of the drop line cover 24 and terminates at a point adjacent the upper end. The drop line cover 24 is normally constructed of a light metal, such as light weight aluminum, and the material of the drop line cover 24 between the end of the slit 38 and the upper end of the cover 24 is readily deformable and serves as the hinge for articulating the opposing members 30 and 31.

Figure 5:
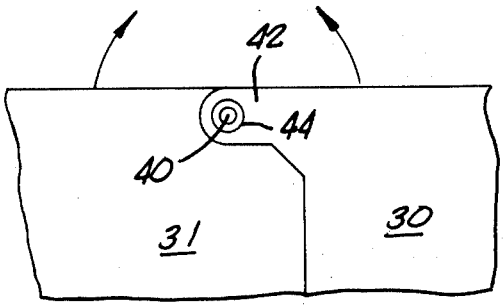
FIG. 5 is a fragmentary view of a portion of a drop line cover illustrating one method of hinging the opposing members together.

If desired, however, the opposing members 30 and 31 can be hinged such as illustrated in FIG. 5. In FIG. 5 the drop line cover 24 is manufactured in two parts with one part containing outwardly extending pivot pins 40 and the second part being formed with projections or ears 42 which are provided with openings 44 for receiving the pivot pins 40. The opposing members 30 and 31 are thus articulated and pivot about points defined by the pivot pins 40.

Figure 6:
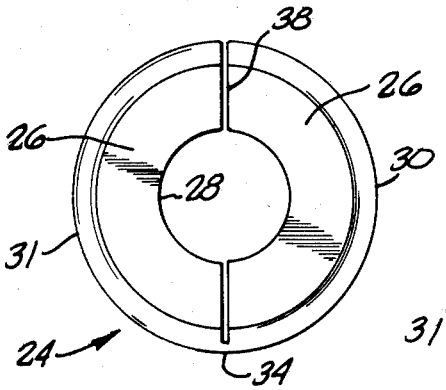
FIG. 6 is a bottom view of a drop line cover illustrating another embodiment of the invention.
Figure 7:
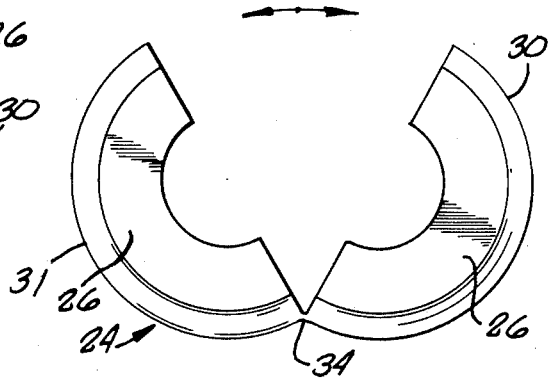
FIG. 7 is a bottom view of the drop line cover of FIG. 6 showing the opposing members in an open position.

In accordance with the present invention it is essential that the drop line cover 24 be so constructed as to be removable from the drop line 12 without the necessity of removing the sprinkler head 18. Accordingly, the invention is not limited to the embodiments illustrated in FIGS. 1 through 5. As illustrated in FIG. 6 in another embodiment of the invention, the drop line cover 24 is provided on one wall with a single through-running cut which extends parallel to the axis of rotation of the drop line cover 24. The wall area opposite the slit 38 may serve as the hinge area about which the opposable members 30 and 31 pivot or the drop line cover 24 may be manufactured as two separate elements which are joined by hinge means on the drop line cover opposite the slit 38. In either case the opposable members 30 and 31 pivot about an axis parallel to the axis of rotation of the drop line cover 24 so that one wall of the drop line cover 24 can be opened to permit removal of the drop line cover 24 without interrupting the integrity of the system.

While the invention has been described in connection with certain preferred embodiments thereof, it will be apparent that it may be otherwise embodied without departing from the spirit and scope of the invention as defined in the following claims.

I claim:

1. An escutcheon assembly comprising a skirt having a substantially centrally disposed opening and an open ended cylindrical line cover removably disposed in said opening, the improvement wherein said line cover consists of a pair of opposed articulated members which are defined by a pair of opposed slits extending from one open end of said line cover and terminating on said line cover inwardly of said other open end, a portion of said line cover between the terminus of said slits and said opposite open end being deformable to define hinge means for the movement of the opposed members to an open position whereby said line cover can be placed over and removed from a line in a fluid conducting system without breaking system integrity.

* * * * *